US011128083B2

(12) United States Patent
Tsuji et al.

(10) Patent No.: US 11,128,083 B2
(45) Date of Patent: Sep. 21, 2021

(54) COVER FOR L-SHAPED CONNECTOR

(71) Applicant: FUJI CORPORATION, Chiryu (JP)

(72) Inventors: Mayumi Tsuji, Okazaki (JP); Yoshinori Nagata, Anjo (JP)

(73) Assignee: FUJI CORPORATION, Chiryu (JP)

( * ) Notice: Subject to any disclaimer, the term of this patent is extended or adjusted under 35 U.S.C. 154(b) by 152 days.

(21) Appl. No.: 16/481,135

(22) PCT Filed: Feb. 6, 2017

(86) PCT No.: PCT/JP2017/004238
§ 371 (c)(1),
(2) Date: Jul. 26, 2019

(87) PCT Pub. No.: WO2018/142617
PCT Pub. Date: Aug. 9, 2018

(65) Prior Publication Data

US 2021/0135392 A1 May 6, 2021

(51) Int. Cl.
*H01R 13/516* (2006.01)
*H01R 13/422* (2006.01)
*H01R 13/629* (2006.01)
*H01R 13/56* (2006.01)

(52) U.S. Cl.
CPC ..... *H01R 13/516* (2013.01); *H01R 13/4223* (2013.01); *H01R 13/629* (2013.01); *H01R 13/56* (2013.01)

(58) Field of Classification Search
CPC ..... H01R 13/516; H01R 13/4223; H01R 13/629; H01R 13/56
USPC ..... 439/426
See application file for complete search history.

(56) References Cited

U.S. PATENT DOCUMENTS 3,675,184 A * 7/1972 Vetter ..... H01R 13/59 439/462
4,109,992 A * 8/1978 Hughes ..... H01R 13/567 439/620.21
5,259,785 A * 11/1993 Inaba ..... H01R 13/58 439/364

(Continued)

FOREIGN PATENT DOCUMENTS

JP 4-25428 U 2/1992
WO WO 2011/077685 A1 6/2011

OTHER PUBLICATIONS

International Search Report dated Apr. 25, 2017 in PCT/JP2017/004238 filed on Feb. 6, 2017.

*Primary Examiner* — Alexander Gilman
(74) *Attorney, Agent, or Firm* — Oblon, McClelland, Maier & Neustadt, L.L.P.

(57) ABSTRACT

A cover for protecting an L-shaped connector including: a cover main body configured to integrally cover a connector section and a cable holding section of an L-shaped connector having a connector portion serving as a portion to be inserted into a connection port and a cable holding section configured to guide a cable from the connector section in a direction orthogonal to the connector section; a connector cover section that is configured to cover the connector section among the cover main body; and a finger hold section provided on the connector cover section and protruding outward in a direction orthogonal to a center line of the connector portion.

5 Claims, 6 Drawing Sheets

(56) References Cited

U.S. PATENT DOCUMENTS 5,391,092 A * 2/1995 Sumida ..... H01R 13/516 439/470
5,725,397 A * 3/1998 Fukamachi ..... H01R 13/514 439/701
5,971,791 A * 10/1999 Itoh ..... H01R 13/5202 439/364
6,062,909 A * 5/2000 Zeller ..... B60R 21/01 439/620.21
6,203,362 B1 * 3/2001 Tsuji ..... H01R 13/506 439/470
6,361,356 B1 * 3/2002 Heberlein ..... H01R 13/62977 439/157
6,435,891 B1 * 8/2002 Beck, Jr. ..... H01R 13/6315 439/248
6,926,535 B2 * 8/2005 Tsuji ..... H01R 13/501 439/31
6,962,504 B2 * 11/2005 Fukui ..... H01R 13/562 439/466
7,014,498 B1 * 3/2006 Munoz ..... H01R 13/5025 439/352
7,476,121 B2 * 1/2009 Tsuji ..... H01R 13/4223 439/465
7,537,479 B2 * 5/2009 Miyamoto ..... H01R 13/506 439/468
7,950,968 B2 * 5/2011 Qian ..... H01R 13/506 439/689
8,192,229 B2 * 6/2012 Endo ..... H01R 13/501 439/596
8,568,159 B2 * 10/2013 Noda ..... H01R 13/5812 439/470
8,882,521 B2 * 11/2014 Conway ..... H01R 13/62977 439/157
8,926,378 B2 * 1/2015 Tanimura ..... H01R 13/514 439/701
9,088,091 B2 * 7/2015 Suzuki ..... H01R 13/447
9,093,765 B2 * 7/2015 Kuji ..... H01R 13/193
9,257,772 B2 * 2/2016 Natter ..... H01R 13/506
9,306,332 B2 * 4/2016 Kuji ..... H01R 13/193
9,312,646 B2 * 4/2016 Kuji ..... H01R 24/28
10,063,007 B2 * 8/2018 Sugimoto ..... H01R 13/5812
10,205,266 B1 * 2/2019 Peterson ..... H01R 13/506
2005/0106911 A1 * 5/2005 Sharples ..... H01R 13/62977 439/157
2006/0099851 A1 * 5/2006 Duarte ..... H01R 13/567 439/502
2009/0020309 A1 * 1/2009 Foltz ..... H02G 3/0487 174/97
2012/0302085 A1 * 11/2012 Kyoyama ..... H01R 13/516 439/357
2014/0045361 A1 * 2/2014 Gunreben ..... H01R 13/6275 439/345

* cited by examiner

COVER FOR L-SHAPED CONNECTOR

TECHNICAL FIELD

The present application relates to a cover for an L-shaped connector that is integrally attached to an L-shaped connector when the L-shaped connector is used.

BACKGROUND ART

A device that needs to be electrically connected is known to use, for example, a connector with a cable, and there are cases in which an L-shaped connector is used when the side of the device with a connection port is close to another device or a wall. Such an L-shaped connector is formed with a connector section having a plug-in portion corresponding to the device, and a cable holding portion for guiding a cable from the connector section in a direction orthogonal to the connector portion. Patent literature 1 discloses a cover for an L-shaped connector for covering the L-shaped connector. The L-shaped connector cover is formed by a cover member having a shape in which the outer shape of the L-shaped connector is divided into two, and is integrated by inserting the L-shaped connector into the cover member and screwing the L-shaped connector. A handle section for facilitating handling of the L-shaped connector is also formed on the L-shaped connector cover.

CITATION LIST

Patented Literature

Patent literature 1: JP-04-25428U

BRIEF SUMMARY

Problem to be Solved

However, since the L-shaped connector cover of the conventional example covers the L-shaped connector using bolts, the handling thereof is troublesome. Although covering the L-shaped connector protects it against external force, it is not effective for the following reasons. As described above, an L-shaped connector is often used when the space on the front side of a connection port is narrow. In this case, an operator cannot perform the attaching/detaching operation with the body facing the front with respect to the connection port, and the operator has to attach/detach the connection port in a state in which their hand is extended.

Therefore, the operation is performed only by their fingers, and the operator tends to grasp the cable holding portion because it is the portion of the L-shaped connector that can be easily grasped (see FIG. 6). Even if the handle portion is provided as in the above-mentioned conventional example, since it is difficult to grasp the handle portion in a narrow space, the operator grasps the cable holding portion. When the L-shaped connector is pulled out by grasping the cable holding section, there are cases in which a moment acts on a corner where stresses tend to concentrate, causing the L-shaped connector to be damaged. This also leads to breakage of the L-shaped connector because high stress acts on the corner even if the above-mentioned cover member is provided. Otherwise, the insertion portion of the L-shaped connector is damaged.

Accordingly, it is an object of the present disclosure to provide a cover for an L-shaped connector for protecting the L-shaped connector.

Solution to Problem

An L-shaped connector cover according to an embodiment of the present disclosure is a cover for L-shaped connector including: a cover main body configured to integrally cover a connector section and a cable holding section of an L-shaped connector having a connector portion serving as a portion to be inserted into a connection port and a cable holding section configured to guide a cable from the connector section in a direction orthogonal to the connector section; a connector cover section that is configured to cover the connector section among the cover main body; and a finger hold section provided on the connector cover section and protruding outward in a direction orthogonal to a center line of the connector portion.

Advantageous Effects

According to the above configuration, since a finger hold section protruding outward in a direction orthogonal to the center line of the connector section is formed on the connector cover section of cover main body covering the L-shaped connector, an operator can easily put their finger on the finger hold section and can pull out in the direction of the center line of the connector section while holding with their finger, so that putting a load on a portion of the L-shaped connector with low rigidity is prevented.

DESCRIPTION OF EMBODIMENTS

Figure 6:
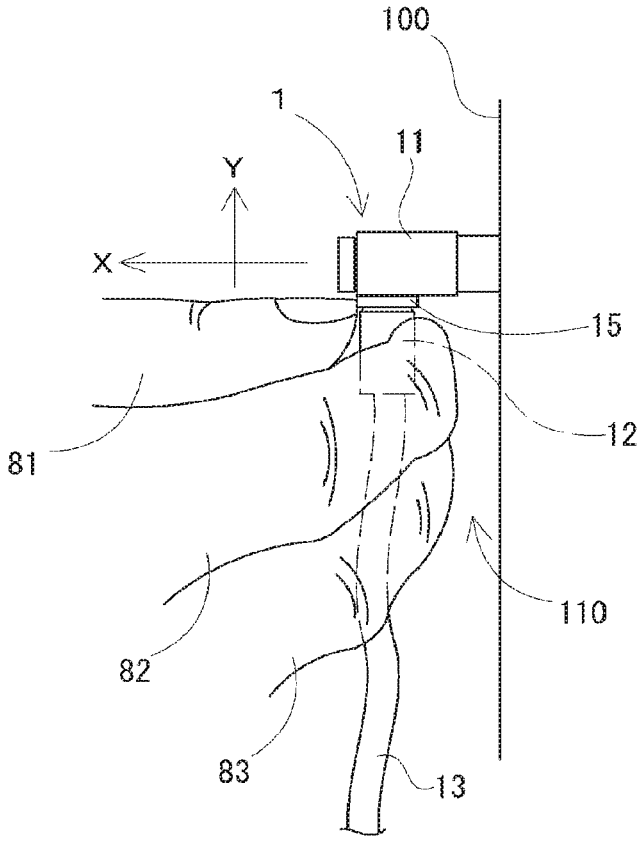
FIG. 6 illustrates a state in which an operator removes an L-shaped connector from a device.

Next, an embodiment of a cover for L-shaped connector according to the present disclosure will be described below with reference to the drawings. Here, FIG. 6 illustrates a state in which an operator removes an L-shaped connector from a device. L-shaped connector 1 includes connector section 11 serving as a portion to be inserted into a connection port of device 100, and cable holding section 12 configured to guide cable 13 in a direction orthogonal to connector section 11. In such an L-shaped connector 1, connector section 11 and cable holding section 12 are formed of a cylindrical member made of metal, and a male screw on the cable holding section 12 side is screwed into and integrated with coupling section 15 provided with a female screw formed on the connector section 11 side.

As shown in the figure, when removing L-shaped connector 1 that is inserted into device 100, connector section 11 is pulled out in an X-axis direction along the connection port of device 100. Here, it is preferable that the removal operation by the operator is performed, for example, by pinching connector section 11 with thumb 81 and index finger 82 and extracting connector section 11 so as to apply a straight force in the X-axis direction. However, when the space in the X-axis direction is small, it becomes difficult to pull out the connection section straight. This is particularly true when a hand is inserted into a narrow space and the removal operation is performed only by the fingers. In such a case, as shown in FIG. 1, in many cases, index finger 82 and middle finger 83 are placed in gap 110 between the side surface of device 100 and cable holding section 12 and cable 13 and then the L-shaped connector 1 is grasped.

However, when the operator tries to pull out the cable in the X-axis direction by the grasping method shown in the drawing, a moment acts on cable holding section 12 because connector section 11 is separated in the Y-axis direction from index finger 82 and middle finger 83 by which the force is applied. In particular, the moment acts on L-shaped connector 1 in the vicinity of coupling section 15 formed at the corner section where stress concentration is apt to occur. Since coupling section 15 has low rigidity, coupling section 15 is liable to be damaged when L-shaped connector 1 is pulled out. Therefore, the cover for the L-shaped connector of the present embodiment is for protecting L-shaped connector 1 from such a force applied during removal, and in particular, is configured so that no stress acts in the vicinity of coupling section 15 that is a corner section.

Figure 1:
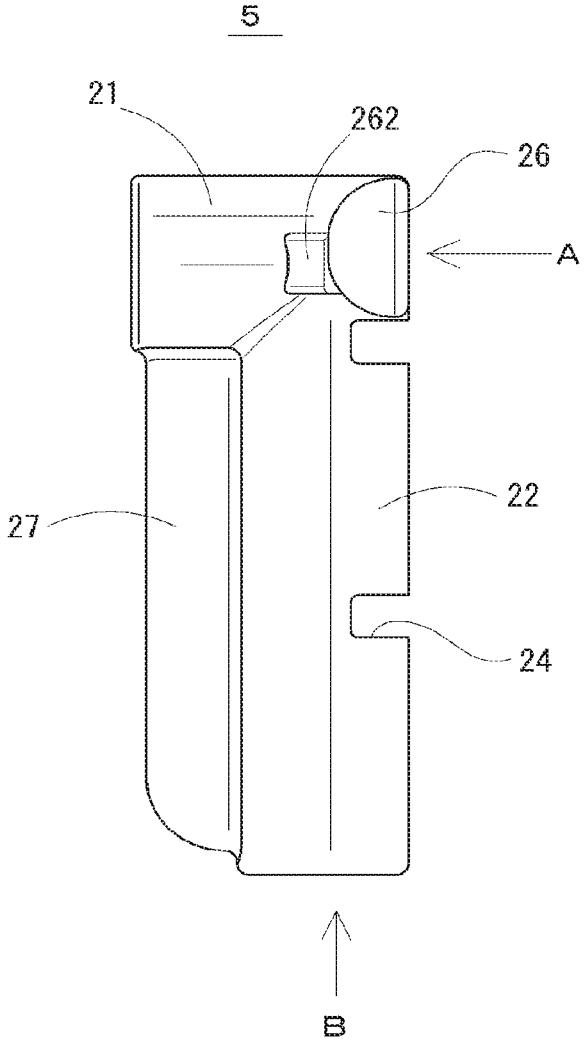
FIG. 1 is a side view showing an embodiment of a cover for an L-shaped connector.
Figure 2:
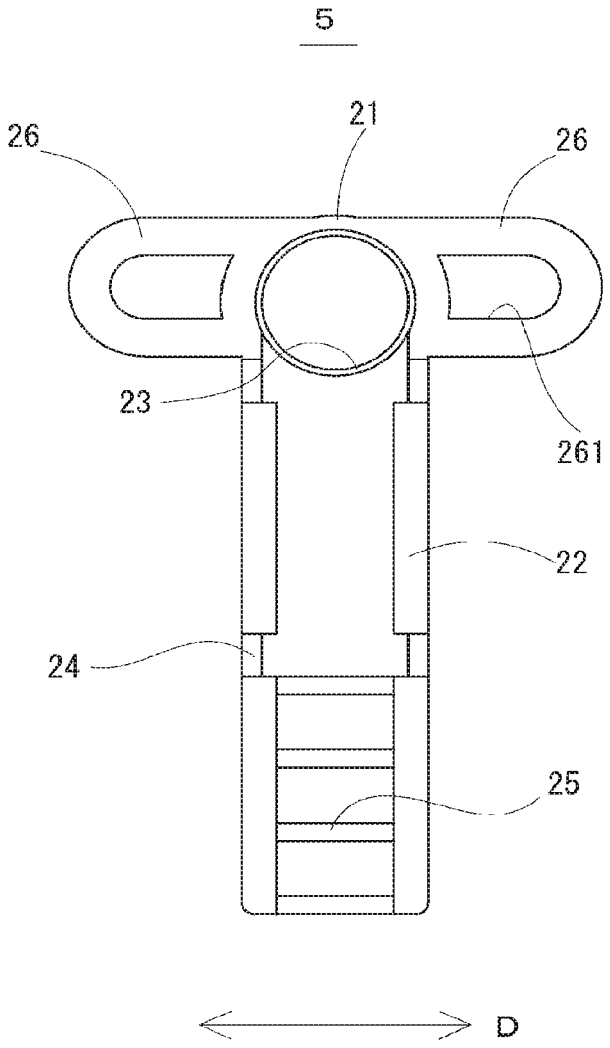
FIG. 2 is a rear view showing an embodiment of a cover for an L-shaped connector from the A direction of FIG. 1.
Figure 3:
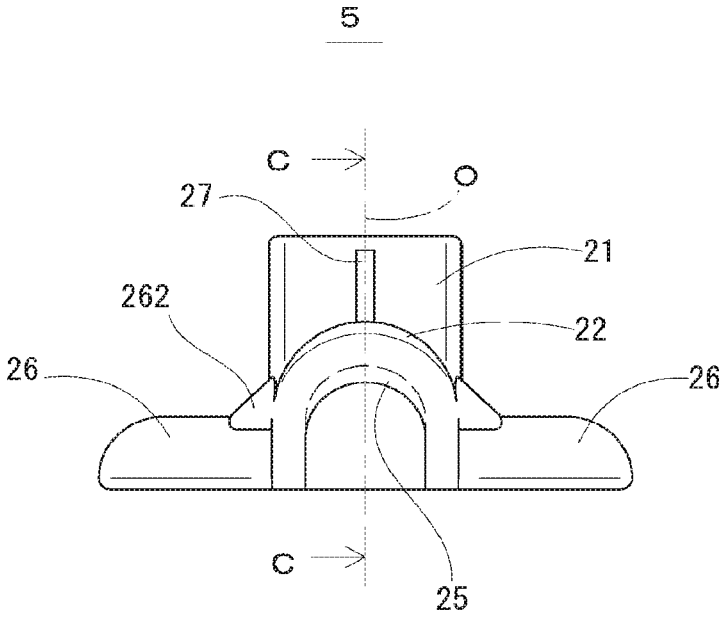
FIG. 3 is an end view showing an embodiment of a cover for an L-shaped connector from the B direction of FIG. 1.
Figure 4:
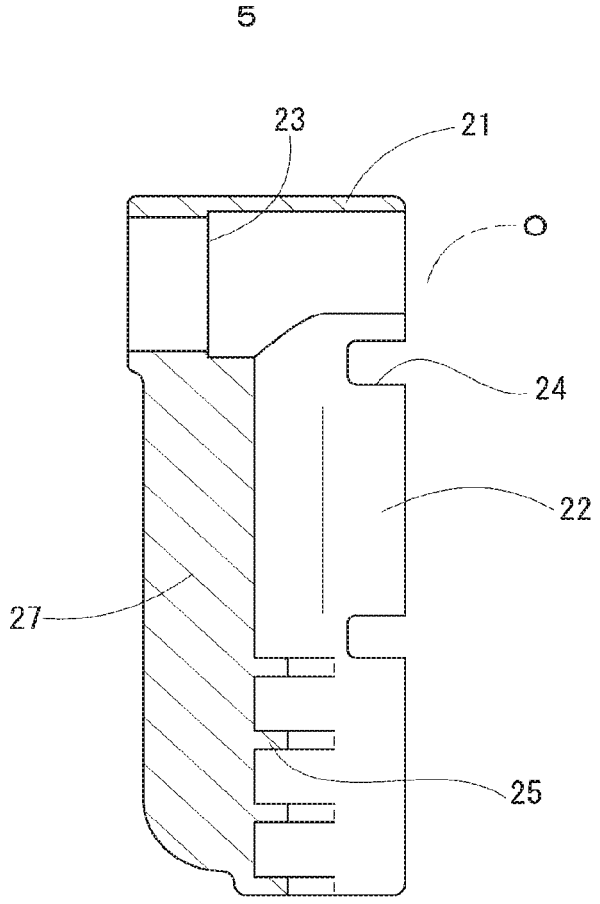
FIG. 4 is a cross section showing an embodiment of a cover for an L-shaped connector from at the C-C line of FIG. 3.
Figure 5:
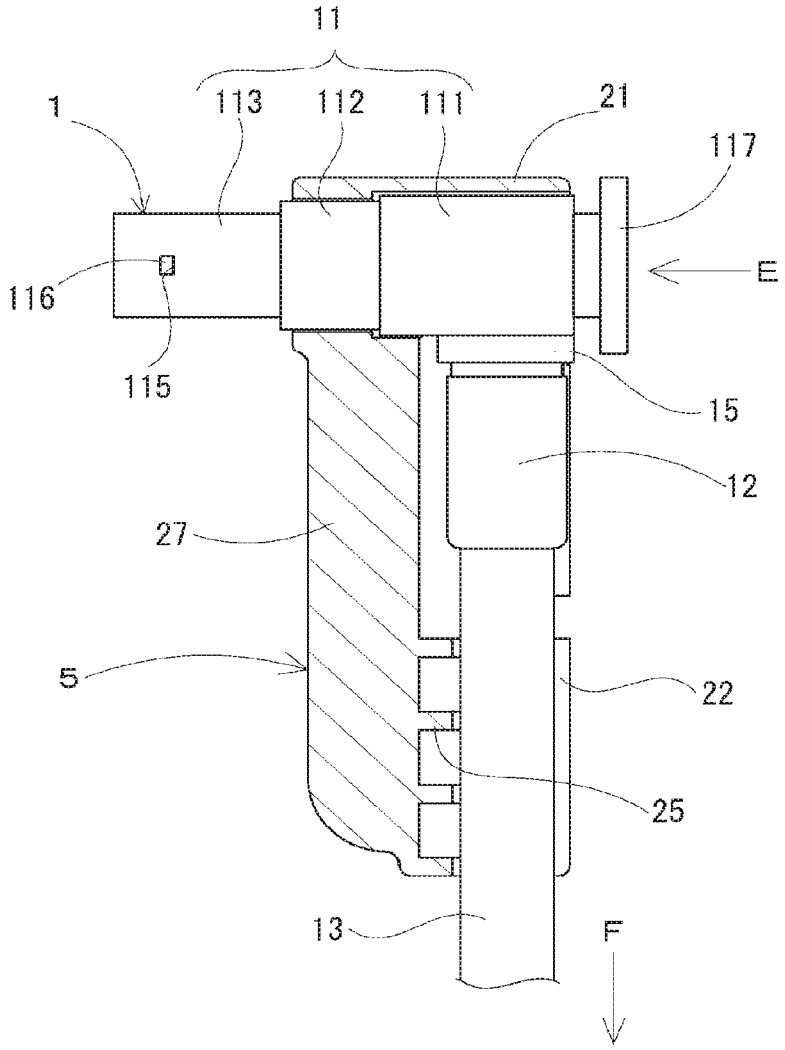
FIG. 5 is a cross section showing a cover for an L-shaped connector mounted on the L-shaped connector in the same cross section as FIG. 4.

Here, FIGS. 1 to 4 are views showing cover for L-shaped connector 5: FIG. 1 is a side view; FIG. 2 is a rear view seen from the direction A of FIG. 1; FIG. 3 is an end view seen from the direction B of FIG. 1; and FIG. 4 is a cross-sectional view taken along the line C-C of FIG. 3. FIG. 5 is a view showing the cover for L-shaped connector mounted on the L-shaped connector in the same cross section as FIG. 4. Cover for L-shaped connector 5 is formed to match the shape of L-shaped connector 1, and is configured from a cover main body including connector cover section 21 that covers connector section 11 and cable holding cover section 22 that covers the cable holding section 12.

Connector cover section 21 has a cylindrical shape having a diameter larger than that of cylindrical connector section 11, and step section 23 corresponding to the shape of connector section 11 is formed on the inner surface of connector cover section 21. As shown in FIG. 5, connector section 11 of L-shaped connector 1 has large diameter section 111, medium diameter section 112, and small diameter section 113, and a latch mechanism is configured such that latch lock 116 protrudes from window 115 in small diameter section 113 which is an insertion section. When push button 117 is pushed in the direction of arrow E, latch lock 116 having an inclined surface is lowered from window 115, and latch lock 116 enters small diameter section 113 such that unlocking is performed. Accordingly, step section 23 of connector cover section 21 is formed so that the tip of large diameter section 111 sticks out in order to receive the E-axis force applied when unlocking.

Next, cable holding cover section 22 of cover for L-shaped connector 5 has a U-shaped groove shape and is orthogonal to connector cover section 21. Cylindrical connector cover section 21 is formed with a cutout section so that the ends of the groove-shaped cable holding cover section 22 can be attached. Accordingly, a space corresponding to the shape of L-shaped connector 1 is formed inside cover for L-shaped connector 5. Since cable holding cover section 22 is U-shaped, cover for L-shaped connector 5 has a shape in which the front surface side of L-shaped connector 1, which is the insertion direction, is covered, and the back surface side, which is the opposite side, shown in FIG. 2, is open, so that L-shaped connector 1 can be fitted from the back surface side.

Cover for L-shaped connector 5 is formed of, for example, a resin material, and when L-shaped connector 1 is fitted, cable holding cover section 22 is slightly elastically deformed, and due to that elastic force L-shaped connector 1 is held after being mounted by being grasped from both sides in the width direction (D-axis direction) shown in FIG. 2. On the other hand, cover for L-shaped connector 5 needs to be hard to protect L-shaped connector 1. Therefore, in order to enable slight elastic deformation while maintaining hardness, multiple cutout sections 24 are formed in the rear surface side end section of cable holding cover section 22.

As shown in FIG. 5, cable holding cover section 22 is formed to have a longer dimension in the feeding direction (F-axis direction) of cable 13 than cable holding section 12 of L-shaped connector 1. This is because cable holding cover section 22 not only holds L-shaped connector 5 but also supports cable 13. When the connection port of device 100 has a certain height, the weight of cable 13 is applied to the vicinity of coupling section 15 of L-shaped connector 1. In addition, an object may be caught on cable 13 such that a pulling force acts on the vicinity of coupling section 15 of L-shaped connector 1.

Therefore, in cover for L-shaped connector 5, by lengthening cable holding cover section 22, such a force is received by cable 13, which is flexible, at a position away from coupling section 15 of L-shaped connector 1. Further, multiple protrusions 25 for reducing the inner dimension of cable holding cover 22 are formed in the feeding direction (F-axis direction) of cable 13 so as to hold cable 13. Since cable holding cover section 22 also holds cable 13 in this manner, the tensile force described above hardly acts on the vicinity of coupling section 15 having low rigidity.

Next, in cover for L-shaped connector 5 of the present embodiment, two finger hold sections 26 are formed in connector cover section 21 so that when L-shaped connector 1 is pulled out from device 100, force is correctly applied to L-shaped connector 1. The two finger hold sections 26 are formed so as to protrude from connector cover section 21 in two opposite directions with the center line O therebetween. More specifically, they are formed at the rear side end section of connector section 11 and extend to both sides in the width direction (D-axis direction) orthogonal to the feeding direction (F-axis direction) of cable 13.

Therefore, with cover for L-shaped connector 5, two fingers of the operator extending from the rear surface side (that is, in the direction indicated by the arrow E in FIG. 5) of the connector cover section 21 can each hold a finger hold section 26. Normally, in order to hold finger hold sections 26 with their index finger and middle finger, the operator can press push button 117 with their thumb. Further, finger hold sections 26 are formed with a curved surface on the front surface side of cover for L-shaped connector 5 that the fingers hold so that the fingers can easily hold the finger hold sections 26. As shown in FIG. 2, concave section 261 and fillet section 262 are respectively formed on the rear surface side and the front surface side of finger engaging section 26 so that the stress concentration acting on the base section is reduced.

Note that, since finger holding sections 26 function by being held by the fingers, this function is not made use of if the operator grasps cable holding cover section 22 to perform the removal operation. However, as described above, in a case where L-shaped connector 1 is pulled out by extending the hand in a narrow space, it is conceivable that the operator may grasp cable holding cover section 22 even if finger holding sections 26 are present. Therefore, cover for L-shaped connector 5 is formed with a finger hold prevention section 27 for preventing the finger from holding cable holding cover section 22.

Finger hold prevention section 27 is configured to prevent a finger from entering gap 110 (see FIG. 6) between cable holding cover section 22 and the side of the device. Finger hold prevention section 27 of the present embodiment is formed as a plate along the feeding direction of cable 13 (the F-axis direction shown in FIG. 5), and protrudes from the top section of the front surface side of cable holding cover section 22. Finger hold prevention section 27 has front surface end section 271 protruding to the vicinity of end section 221 of connector cover section 21. When L-shaped connector 1 is attached to device 100, since L-shaped connector 1 is inserted to the extent that the tip end of medium diameter section 112 shown in FIG. 5 abuts the device, finger hold prevention section 27 is arranged in gap 110 between the side surface of device 100 and cable holding cover section 22.

Accordingly, since cover for L-shaped connector 5 of the present embodiment is configured so that L-shaped connector 1 can be fitted from the open rear surface side, the operator can easily attach and detach cover for L-shaped connector 5 to and from L-shaped connector 1. Further, cover for L-shaped connector 5 can be pulled out without exerting a moment on cable holding section 12 by hooking fingers on finger holding sections 26. Therefore, a large load is not applied to the corner section of L-shaped connector 1 having low rigidity in the vicinity of coupling section 15, thus preventing breakage.

The two finger holding sections 26 are arranged on opposite sides of connector cover 21 sandwiching center line O, making it easier for the operator to hold using their fingers. Further, pushbutton 117 of L-shaped connector 1 is also easily pressed by holding the fingers on the two finger holding sections 26. In addition, since cover for L-shaped connector 5 is formed with finger hold prevention section 27, when L-shaped connector 1 is pulled out from device 100, the operator naturally hooks their fingers on finger holding sections 26. This is because even if cable holding cover 22 of cover for L-shaped connector 5 is grasped to remove L-shaped connector 1, the fingers do not enter gap 110 formed with device 100. Also, even if cable holding cover section 22 is pinched and pulled out, push button 117 of the L-shaped connector 1 is difficult to press.

Further, since cover for L-shaped connector 5 supports cable 13 by increasing the size of cable holding cover section 22, the force applied to the vicinity of coupling section 15 of L-shaped connector 1 via cable 13 is reduced, and breakage of coupling section 15, in which stress is easily concentrated, is prevented. Therefore, using cover for L-shaped connector 5 protects L-shaped connector 1 by covering it, and by making it difficult to exert force on the less rigid part of the connector due to removal work and so on.

The above describes an embodiment of the present disclosure, but embodiments are not limited to the above and various changes may be employed without departing from the scope of the disclosure. For example, finger hold prevention section 27 may be arranged not at the top of the front surface side of cable holding cover section 22 as shown in FIG. 3, but inclined in the direction towards gap 110 into which the index finger or the middle finger enters. This is because it may be considered that this makes it more difficult for the operator to grasp cable holding cover portion 22. In addition, finger holding sections 26, finger hold prevention section 27, and the like may have shapes different from those of the embodiment.

REFERENCE SIGNS LIST

1: L-shaped connector; 5: cover for L-shaped connector; 11: connector section; 12: cable holder; 13: cable; 15: coupling section; 21: connector cover section; 22: cable holding cover section; 26: finger hold section; 27: finger hold prevention section

The invention claimed is:

1. A cover for L-shaped connector comprising:

a cover main body configured to integrally cover a connector section and a cable holding section of an L-shaped connector having a connector portion serving as a portion to be inserted into a connection port and a cable holding section configured to guide a cable from the connector section in a direction orthogonal to the connector section;

a connector cover section that is configured to cover the connector section among the cover main body; and a finger hold section provided on the connector cover section and protruding outward in a direction orthogonal to a center line of the connector portion, wherein the cable holding cover section of the cover main body is longer in a cable feeding direction than the cable holding section of the L-shaped connector that is covered.

2. A cover for L-shaped connector comprising:

a cover main body configured to integrally cover a connector section and a cable holding section of an L-shaped connector having a connector portion serving as a portion to be inserted into a connection port and a cable holding section configured to guide a cable from the connector section in a direction orthogonal to the connector section;

a connector cover section that is configured to cover the connector section among the cover main body; and a finger hold section provided on the connector cover section and protruding outward in a direction orthogonal to a center line of the connector portion, wherein the connector cover section has a cylindrical shape, and further provided is a cable holding cover section configured to cover the cable holding section and having a U-shaped shape covering a front surface side that is an insertion direction of the L-shaped connector and open on a back surface side that is opposite to a front side.

3. The cover for L-shaped connector according to claim 1, wherein the finger hold section protrudes in two opposite directions across a center portion of the connector cover section.

4. The cover for L-shaped connector according to claim 1, wherein a finger hold prevention section configured to prevent a finger from catching at the front surface side that is an insertion direction of the L-shaped connector is formed in the cable holding cover section configured to cover the cable holding section among the cover main body.

5. The cover for L-shaped connector according to claim 4, wherein the finger hold prevention section is formed as a plate established along the cable feeding direction on the front surface side of the cable holding cover section.

* * * * *